US005695576A

United States Patent [19]

Beguinot

[11] Patent Number: 5,695,576

[45] Date of Patent: Dec. 9, 1997

[54] HIGH DUCTILITY STEEL, MANUFACTURING PROCESS AND USE

[75] Inventor: Jean Beguinot, Le Creusot, France

[73] Assignee: Creusot Loire Industrie (S.A.), Puteaux, France

[21] Appl. No.: 590,737

[22] Filed: Jan. 24, 1996

[30] Foreign Application Priority Data

Jan. 31, 1995 [FR] France ..... 95 01079

[51] Int. Cl.[6] ..... C21D 8/00; C22C 38/14; C22C 38/06; C22C 38/28

[52] U.S. Cl. ..... 148/328; 148/335; 148/547; 148/654; 420/106; 420/109

[58] Field of Search ..... 148/328, 335, 148/547, 654; 420/106, 109

[56] References Cited

U.S. PATENT DOCUMENTS

| | | | |
|---|---|---|---|
| 2,791,500 | 5/1957 | Foley et al. . | |
| 4,957,702 | 9/1990 | Fang et al. | 420/106 |
| 5,279,902 | 1/1994 | Materkowsk | 148/335 |

FOREIGN PATENT DOCUMENTS

| | | | |
|---|---|---|---|
| 1342845 | 2/1964 | France . | |
| 1443519 | 9/1966 | France . | |
| 58-55554 | 4/1983 | Japan | 420/106 |
| 59-16948 | 1/1984 | Japan | 420/106 |
| 406057330 | 3/1994 | Japan | 148/654 |
| 1032039 | 7/1983 | U.S.S.R. | 420/109 |

*Primary Examiner*—Deborah Yee
*Attorney, Agent, or Firm*—Oblon, Spivak, McClelland, Maier & Neustadt, P.C.

[57] ABSTRACT

High-strength high-ductility steel whose chemical composition, by weight, comprises from 0.15% to 0.35% of carbon, from 0% to 3% of silicon, from 0% to 3% of aluminium, from 0.1% to 4.5% of manganese, from 0% to 9% of nickel, from 0% to 6% of chromium, from 0% to 3% of the sum of tungsten divided by two plus molybdenum, from 0% to 0.5% of vanadium, from 0% to 0.5% of niobium, from 0% to 0.5% of zirconium, at most 0.3% of nitrogen and, optionally, from 0.0005% to 0.005% of boron, optionally from 0.005% to 0.1% of titanium, optionally at least one element taken from Ca, Se, Te, Bi and Pb in contents less than 0.2%, the balance being iron and impurities resulting from smelting; the chemical composition furthermore satisfying the relationships: $1\% \leqq Si+Al \leqq 3\%$ and $4.6\times(\%C)+1.05\times(\%Mn)+0.54\times(\%Ni)+0.66\times(\%Mo+\%W/2)+0.5\times(\%Cr)+K \geqq 3.8$ where K=0.5 when the steel contains boron, K=0 when the steel does not contain boron. Process for the manufacture of a component made of such a steel, component obtained and uses.

30 Claims, No Drawings

HIGH DUCTILITY STEEL, MANUFACTURING PROCESS AND USE

FIELD OF THE INVENTION

The present invention relates to a weldable steel having a high tensile strength and good ductility.

PRIOR ART

In order to manufacture equipment intended, for example, either to resist abrasion or to resist concentrated and highly energetic shocks, metal sheets having a thickness greater than 8 mm are used, these being made of quench tempered low alloy steel having a high mechanical strength (tensile strength greater than 1200 MPa), the structure of which is martensitic or martensito-bainitic. The equipment thus manufactured exhibits better in-service behavior the higher the tensile strength of the steel but also the greater its fracture energy. The fracture energy increases as the ductility of the steel increases. This ductility is measured by the degree of elongation just before necking in a tensile test (uniform elongation). Since the sheets are generally welded, the steel used must also be weldable. Quench tempered low alloy steels whose structure is martensitic or martensito-bainitic allow a combination of high tensile strength and satisfactory weldability but they have the drawback of having very poor ductility: the uniform elongation becomes less than 5% as soon as the tensile strength exceeds 1200 MPa.

In order to reconcile high tensile strength and good ductility, it has been proposed to use steels containing especially between 0.5% and 3% of silicon and subjected to a staged quenching treatment after either complete austenization or an intercritical treatment. However, these steels and these heat treatments have drawbacks.

The steels in question either are not weldable, or do not allow a high enough tensile strength to be obtained or, finally, only allow all the desired properties to be obtained on thin sheets having a thickness substantially less than 8 mm.

The staged quenching heat treatment, comprising cooling at a cooling rate greater than or equal to 50° C./s down to a hold temperature, then an isothermal hold at this temperature and, finally, cooling down to room temperature, is well suited to thin sheets or to small engineering components but it is completely unsuitable for thick sheets, in particular when they are of large size. Cooling a sheet at a cooling rate greater than 50° C./s is increasingly difficult the thicker the sheet and, simply because of the laws governing heat transfer, this even becomes impossible when the thickness of the sheet exceeds 15 mm. In addition, following rapid cooling with an isothermal hold is a common operation for small engineering components, for example by using a salt bath, or for thin strip coiled on exiting a hot-rolling mill, but this is a very inconvenient and therefore very expensive operation when it has to be carried out on a thick sheet of large size.

Intercritical treatments are also unsuitable for the manufacture of sheets having a very high yield stress. The reason for this is that these treatments consist in raising the steel to a temperature intermediate between the austenization start temperature and the complete austenization temperature so that such a treatment followed by a quench leads to hybrid structures consisting of a mixture of quenched and very soft ferrite structures. The presence of very soft ferrite significantly reduces the level. of tensile strength obtainable.

SUMMARY OF THE INVENTION

The aim of the present invention is to remedy these drawbacks by providing a weldable steel which makes it possible to manufacture, in an industrial manner, sheets having a thickness greater than 8 mm which are weldable, have a tensile strength greater than 1200 MPa and have very good ductility, that is to say a degree of uniform elongation greater than 5%.

For this purpose, the subject of the invention is a steel whose chemical composition, by weight, comprises:

$$0.15\% \leq C \leq 0.35\%$$

$$0\% \leq Si \leq 3\%$$

$$0\% \leq Al \leq 3\%$$

$$0.1\% \leq Mn \leq 4.5\%$$

$$0\% \leq Ni \leq 9\%$$

$$0\% \leq Cr \leq 6\%$$

$$0\% \leq Mo+W/2 \leq 3\%$$

$$0\% \leq V \leq 0.5\%$$

$$0\% \leq Nb \leq 0.5\%$$

$$0\% \leq Zr \leq 0.5\%$$

$$N \leq 0.3\%$$

optionally from 0.0005% to 0.005% of boron, optionally from 0.005% to 0.1% of titanium, optionally at least one element taken from Ca, Se, Te, Bi and Pb in amounts less than 0.2%, the balance being iron and impurities resulting from smelting, the chemical composition furthermore satisfying the relationships:

$$1\% \leq Si+Al \leq 3\%$$

and, $$4.6\times(\%C)+1.05\times(\%Mn)+0.54\times(\%Ni)+0.66\times(\%Mo+\%W/2)+0.5\times(\%Cr)+K \geq 3.8$$

where

K=0.5 when the steel contains boron,

K=0 when the steel does not contain boron.

DESCRIPTION OF THE PREFERRED EMBODIMENTS

In a particular embodiment, the chemical composition is adjusted so that:

$$0.005\% \leq Ti \leq 0.1\%$$

$$0.01\% \leq Al \leq 0.5\%$$

$$0.003 \leq N \leq 0.02\%$$

and when the steel is in the solid state, the number of titanium nitride precipitates of size greater than 0.1 μm, counted over an area of 1 $mm^2$ of a micrograph section, is less than 4 times the total content of titanium precipitated in the form of nitrides, this content being expressed in thousandths of a % by weight.

Preferably the steel contains from 0.5% to 3% of chromium, less than 2% of manganese and the molybdenum content plus half the tungsten content is between 0.1% and 2%.

It is desirable for the sum of the silicon and aluminum contents to be between 1.5% and 2.5% and it is preferable for the carbon content to be between 0.2% and 0.3%.

Preferably, the chemical composition of the steel comprises, by weight:

$$0.20\% \leq C \leq 0.24\%$$

$$0\% \leq Si \leq 2.5\%$$

$$0\% \leq Al \leq 2.5\%$$

$$1.2\% \leq Mn \leq 1.7\%$$

$$1.5\% \leq Ni \leq 2.5\%$$

$$0.5\% \leq Cr \leq 1.5\%$$

$$0.1\% \leq Mo+W/2 \leq 0.5\%$$

the chemical composition furthermore satisfying the relationships:

$$1.5\% \leq Si+Al \leq 2.5\%$$

and $$4.6\% \times (\%C)+1.05 \times (\%Mn)+0.54 \times (\%Ni)+0.66 \times (\%Mo+\%W/2)+0.5 \times (\%Cr)+K \geq 3.8$$

where

K=0.5 when the steel contains boron,

K=0 when the steel does not contain boron.

The invention also relates to a process for the manufacture of a component made of high strength high ductility steel, in which:

a steel in accordance with the invention is smelted;

the steel is cast and solidified in the form of a semi finished product;

the semi finished product is formed by hot plastic deformation in order to obtain a steel component;

the component is austenized by heating above $Ac_3$ and then cooled down to room temperature in such a way that the rate of cooling between the austenization temperature and $M_s$+150° C. is greater than 0.3° C./s, such that the residence time between $M_s$+150° C. and $M_s$−50° C. is between 5 minutes and 90 minutes and such that the rate of cooling below $M_s$−50° C. is greater than 0.02° C./s.

In another embodiment of the process:

a steel in accordance with the invention is smelted;

the steel is cast and solidified in the form of a semi finished product;

the semi finished product is heated to a temperature of less than 1300° C. and shaped by hot plastic deformation in such a way that the temperature at the end of shaping by hot plastic deformation is greater than $Ac_3$, in order to obtain a steel component;

the steel component is cooled down to room temperature in such a way that the rate of cooling between the austenization temperature and $M_s$+150° C. is faster than 0.3° C./s, such that the residence time between $M_s$+150° C. and $M_s$−50° C. is between 5 minutes and 90 minutes and such that the rate of cooling below $M_s$−50° C. is greater than 0.02° C./s.

In both cases, in order to cool the component down to room temperature, the component is left to cool in air.

Finally, the invention relates to a steel component, and especially a sheet having a thickness greater than 8 mm, obtained by the process according to the invention, the tensile strength of which is greater than 1200 MPa and the ductility measured by the uniform elongation is greater than 5%. The structure of the component contains from 5% to 30% and preferably from 10% to 20% of residual austenite. When the steel contains titanium, its structure preferably contains more than 30% of bainite.

This component is particularly suitable for the manufacture of mining or quarrying equipment which has to withstand abrasion or for the manufacture of metallic structural components or components fabricated from metal sheet.

The invention will now be described in more detail, but in a non limiting manner.

The steel according to the invention is a low alloy or medium alloy structural steel which makes it possible to obtain, by a suitable heat treatment, a hybrid structure consisting of bainite and/or martensite, and from 5% to 30%, preferably from 10% to 20%, of austenite having a high carbon content. The inventors have discovered that such a structure has the advantage of combining very high tensile strength with very good ductility, even for low carbon contents, which enables good weldability to be obtained, but on condition that the steel contains enough alloy elements which increase the hardenability. The increase in ductility results from the instability of austenitc which is transformed into martensite when the steel undergoes plastic deformation. The transformation of austenite into martensite, induced by the plastic deformation, has an effect on the work-hardening coefficient which is conducive to increasing the degree of uniform elongation measured in a tensile test. In order for this effect to be significant, the austenitc content of the structure must be greater than 5% and preferably greater than 10%; however, this content must remain less than 30% and preferably 20% in order to prevent too great a reduction in the yield stress.

In order to make it possible to obtain a tensile strength greater than 1200 MPa, the steel must contain more than 0.15% of carbon and preferably more than 0.2%. In order to prevent deterioration of the weldability, the carbon content must remain less than 0.35% and preferably less than 0.3%. For the applications envisaged, the optimum carbon content is between 0.2% and 0.24%.

In order to encourage carbon enrichment of the austenite during the heat treatment, the steel must contain at least one element taken from silicon and aluminum. The sum of the silicon and aluminum contents must be greater than 1% and preferably greater than 1.5%. Mowever, in order to avoid smelting difficulties, this sum must remain less than 3% and preferably less than 2.5%. Thus, the aluminum and silicon contents are each between 0% and 3%.

In order to obtain the desired properties, and especially to allow manufacture under satisfactory conditions of sheets having a thickness greater than 8 mm and having the required characteristics, the steel must be sufficiently hardenable so that a suitable heat treatment produces a structure consisting of austenlte and of lower bainire or of martensite, and which contains neither granular ferrite nor ferrite-pearlite. To achieve this, the steel must contain at least one element taken from manganese, nickel, chromium, molybdenum, tungsten and boron, and its chemical composition must satisfy the relationship:

$$4.6 \times (\%C)+1.05 \times (\%Mn)+0.54 \times (\%Ni)+0.66 \times (\%Mo+\%W/2)+0.5 \times (\%Cr)+K \geq 3.8$$

where

K=0.5 when the steel contains boron,

K=0 when the steel does not contain boron.

Manganese, which greatly increases hardenability, is also necessary in contents greater than 0.1% in order to obtain good hot ductility, but its content must remain less than 4.5% and preferably less than 2% in order not to overstabilize the austenite. Preferably, the manganese content must be between 1.2% and 1.7%.

Nickel, which is not absolutely necessary, increases the hardenability and has a favorable effect on the weldability and on the low-temperature toughness. However, this element is expensive. In addition, in too high contents, it overstabilizes the austenite. Moreover, its content must remain less than 9%. Preferably, the nickel content must be between 1.5% and 2.5%.

Chromium, molybdenum and tungsten are not absolutely necessary either, but these elements increase the hardenability and, above all, can formcarbides which are very hardening.

Above 6%, chromium no longer has a significant effect for the steels in question and thus its maximum content is limited to this value. Preferably, the chromium content must be greater than 0.5%, also preferably less than 3% and even more preferably less than 1.5%.

Tungsten at any content has effects equivalent to those of molybdenum at half the content. Thus, for these two elements, the sum of the molybdenum content and half the tungsten content is considered. Above 3%, the effect is no longer significant for the steels in question, and this value is a maximum. Although these two elements are not absolutely necessary, it is desirable that the sum of the molybdenum content and half the tungsten content be greater than 0.1%. Preferably, the sum of the molybdenum content and half the tungsten content must be less than 2% and preferably less than 0.5%.

In order to increase the hardenability without modifying the other properties of the steel, it is possible, without this being obligatory, to add between 0.0005% and 0.005% of boron.

In order to increase the hardness slightly, it is possible to add at least one element taken from vanadium, niobium and zirconium, in contents of between 0% and 0.5% for each of these elements.

Steel usually contains less than 0.02% of nitrogen, however it may be desirable to increase the content of this element up to 0.3% in order to provide additional hardening without impairing the weldability.

When the structure of the steel contains more than 30% of bainire, it is possible to increase its toughness by adding between 0.005% and 0.1% of titanium. For this addition to be effective, the steel must then contain between 0.01% and 0.5% of aluminum and between 0.003% and 0.02% of nitrogen, and, in addition, the titanium must be added to the steel in a very progressive manner in order to limit the precipitation of coarse titanium nitrides in the liquid steel. To do this, it is possible, for example, to cover the non deoxidized liquid steel with a slag, to add titanium to the slag, then to add aluminum to the liquid steel and, finally, to agitate using an inert gas. A steel is thus obtained which, in the solid state, is such that the number of titanium nitride precipitates having a size greater than 0.1 μm, counted over an area of 1 $mm^2$ of a micrograph section, is less than 4 times the total content of titanium precipitated in the form of titanium nitrides, this content being expressed in thousandths of a % by weight. When the titanium is in this form in the steel, it considerably refines the structure and the bainitic substructure. This has the effect of lowering the fracture energy transition temperature by at least 30° C. and of significantly increasing the room temperature toughness when the structure of the steel contains at least 30% of bainite.

Finally, in order to improve the toughness or to improve the machinability, it is possible to add at least one element taken from calcium, selenium, tellurium, bismuth and lead, in contents of less than 0.2%.

The balance of the chemical composition of the steel consists of iron and of impurities resulting from smelting.

In a preferred embodiment, the steel contains from 0.2% to 0.24% of carbon, from 1.5% to 2.5% of silicon plus aluminum, from 1.2% to 1.7% of manganese, from 1.5% to 2.5% of nickel, from 0.5% to 1.5% of chromium, from 0.1% to 0.5% of molybdenum, optionally from 0.0005% to 0.005% of boron and optionally from 0.005% to 0.1% of titanium introduced as indicated hereinabove.

With the steel thus defined, it is possible to manufacture steel components, and especially sheets having a thickness greater than 8 mm, whose tensile strength is greater than 1200 MPa and whose uniform elongation is greater than 5%. In order to achieve this, a liquid steel in accordance with the invention is smelted, cast and solidified in the form of a semi-finished product which is shaped by hot plastic deformation, for example by rolling or by forging, and which is subjected to a heat treatment consisting of:

austenization at a temperature greater than the complete austenization temperature $Ac_3$ of the steel;

followed by cooling down to room temperature under conditions such that the rate of cooling between the austenization temperature and the temperature equal to $M_s$+150° C., and preferably $M_s$+100° C. ($M_s$ being the temperature for the start of the martensitic transformation), is greater than 0.3° C./s and such that the transit time between $M_s$+150° C., preferably $M_s$+100° C., and $M_s$−50° C., and preferably $M_s$, is between 5 minutes and 90 minutes, and preferably between 15 minutes and 50 minutes. Cooling down to room temperature must be performed at a cooling rate greater than 0.02° C./s in order to prevent excessive softening of the martensite.

This heat treatment produces a structure consisting of martensite and/or lower bainite, these being scarcely softened, and of from 5% to 30% of residual austenite highly enriched with carbon. In particular, the slow transit near $M_s$ allows carbon enrichment of the austenite. It must therefore be long enough but not too long so as not to oversoften the structure.

The heat treatment may be carried out either while still hot from forming by hot plastic deformation or after this operation.

When the heat treatment is carried out while still hot from forming by hot plastic deformation, the semi finished product must be heated before plastic deformation to a temperature greater than $Ac_3$ and less than 1300° C. in order to prevent excessive coarsening of the austenitic grain, and the plastic deformation (for example the rolling) must preferably be completed above $Ac_3$ in order to prevent the ferrito-pearlitic transformation from starting.

In all cases, the cooling down to a temperature in the vicinity of $M_s$, carried out at a cooling rate greater than 0.3° C./s, may be effected, for example, by controlled spraying using water. The slow transit near $M_s$ may then be achieved by cooling in air, which may also serve for cooling down to room temperature. However, the cooling down to room temperature, which follows the slow transit near $M_s$, may advantageously be carried out by water cooling so as to limit as far as possible the self-tempering of the structure obtained.

When the massiveness of the product lends itself to this, the cooling down to near $M_s$, the slow transit near $M_s$ and the cooling doWn to room temperature may be carried out directly by air cooling. This is the case especially when the product is a sheet having a thickness at least equal to 30 mm. Sheets having a thickness less than 30 mm may also be treated by air cooling by stacking several sheets so as to form a packet having a thickness greater than 30 mm.

When the heat treatment is carried out after the shaping by hot plastic deformation and return of the product to room temperature, the product must be austenized by heating to above $Ac_3$ so as to obtain complete austenization, and then it may be cooled either in the same manner as when the heat treatment is carried out while the product is still hot from shaping or by any means suitable for carrying out the recommended heat cycle.

By way of example, sheets having a thickness of 20 mm were produced from steels A and C according to the invention and, by way of comparison, from steel B according to the prior art.

The chemical compositions of these alloys were, in thousandths of a % by weight:

| | C | Si | Al | Mn | Ni | Cr | Mo | B | Ti |
|---|---|---|---|---|---|---|---|---|---|
| A | 215 | 2050 | 65 | 1430 | 2044 | 1020 | 210 | 2.7 | 0 |
| B | 252 | 395 | 67 | 1570 | 660 | 1615 | 207 | 2.9 | 0 |
| C | 219 | 1994 | 27 | 1447 | 2020 | 1008 | 203 | 2.6 | 23 |

The titanium in steel C was introduced in accordance with the invention.

The heat treatments to which the sheets were subjected all included an austenization of 30 minutes at 900° C. followed by:

for steel A, the first example in accordance with the invention: air cooling of two stacked sheets (thickness of the block 40 mm);

for steel A, the second example in accordance with the invention: air cooling of a sheet with a hold for 20 minutes at 338° C. ($M_s$+20° C.) and air cooling down to room temperature;

for steel C, an example in accordance with the invention: air cooling of two stacked sheets (thickness of the block 40 mm); and for steel B, according to the prior art: air cooling of a sheet.

The mechanical properties obtained were as follows:

| | $R_m$ MPa | $R_e$ MPa | uniform elongation | total elongation | Kcv J/cm² | residual austenite |
|---|---|---|---|---|---|---|
| 1st A | 1487 | 769 | 8.7% | 16.5% | 45 | 12% |
| 2nd A | 1442 | 743 | 9.5% | 17.7% | 49 | 14% |
| B, prior art | 1492 | 1045 | 3.2% | 9.9% | 61 | 3.5% |
| C | 1483 | 775 | 8.9% | 16.5% | 74 | 12% |

Still by way of example, sheets having a thickness of 20 mm were produced from steels D and F according to the invention and, by way of comparison, from steels E and G according to the prior art.

The chemical compositions of these steels were, in thousandths of a percent by weight:

| | C | Si | Al | Mn | Ni | Cr | Mo | B |
|---|---|---|---|---|---|---|---|---|
| D | 303 | 880 | 1050 | 195 | 4110 | 559 | 175 | 0 |
| E | 357 | 380 | 27 | 1450 | 1546 | 685 | 223 | 0 |
| F | 152 | 928 | 954 | 1475 | 2536 | 1047 | 215 | 2.8 |
| G | 182 | 351 | 23 | 1492 | 254 | 1717 | 176 | 0 |

The sheets produced from steels D, E and G were austenized at 900° C. for 30 minutes and then:

for steel D, two stacked sheets 20 mm in thickness were air cooled;

for E and G, a sheet 20 mmin thickness was air cooled.

With steel F, in which the titanium was introduced in accordance with the invention, a sheet 40 mm in thickness was produced and treated while still hot from rolling. An ingot was heated to 1200° C. and then rolled, the temperature at the end of rolling being greater than 950° C.; after rolling, the sheet was air cooled.

The mechanical properties obtained were:

| | $R_m$ MPa | $R_e$ MPa | uniform elongation | total elongation |
|---|---|---|---|---|
| D, invention | 1945 | 997 | 5.8% | 12.1% |
| E, prior art | 1930 | 1490 | 1.8% | 7.4% |
| F, invention | 1259 | 645 | 10.1% | 18.1% |
| G, prior art | 1262 | 951 | 4.1% | 11.9% |

These examples show the increase in ductility provided by the invention as well as the favorable effect of the titanium on the toughness (Example C).

For all these examples it has been observed that, for comparable tensile strength, the steels according to the invention haveuniform elongations at least 2.5 times greater than those of the steels according to the prior art.

A dynamic deformation test in compression at a rate of $10^4 s^{-1}$ was also carried out on the sheet made from steel A and strain hardening was observed which was comparable to that of a sheet according to the prior art, the static hardness of which is 500 HB whereas the static hardness of the sheet according to the invention is only 400 HB.

Because of its very good ductility, associated with very high mechanical strength, the steel according to the invention is particularly well suited for the manufacture:

of components resistant to abrasive wear for equipment used especially in the mineral industry (in particular in mines, quarries and cement works), or in civil engineering work, such as teeth, sheets, blades, scrapers, screens, hammers of excavation, crushing, grinding, screening, shoveling, leveling or transporting devices;

of sheets subjected to intense shocks or to concentrated and highly energetic impacts;

of components for metal constructions or components fabricated from metal sheet, which are subjected to considerable cold forming and/or requiring a high safety factor in service, favored by a low value of the $R_e/R_m$ ratio and a high deformability before necking; for example pressure vessels, metal frames and crane jibs, and, more generally, strong components subjected to cold or moderate temperature drawing or deep drawing.

These components are especially sheets having a thickness greater than 8 mm.

I claim:

1. A steel wherein its chemical composition comprises, by weight:

$0.15\% \leqq C \leqq 0.35\%$ $0.005\% \leqq Ti \leqq 0.1\%$ $0.01\% \leqq Al \leqq 0.5\%$ $0.1\% \leqq Mn \leqq 4.5\%$ $0\% \leqq Ni \leqq 9\%$ $0\% \leqq Cr \leqq 6\%$ $0\% \leqq Mo+W/2 \leqq 3\%$ $0\% \leqq V \leqq 0.5\%$ $0\% \leqq Nb \leqq 0.5\%$ $0\% \leqq Zr \leqq 0.5\%$ $0.003\% \leqq N \leqq 0.02\%$ optionally from 0.0005% to 0.005% of boron, optionally at least one element taken from Ca, Se, Te, Bi and Pb in amounts less than 0.2%, the balance being iron and impurities resulting from smelting, the chemical composition furthermore satisfying the relationships:

$$1\% \leqq Si+Al \leqq 3\%$$

and, $$4.6\times(\%C)+1.05\times(\%Mn)+0.54\times(\%Ni)+0.66\times(\%Mo+\%W/2)+0.5\times(\%Cr)+K \geqq 3.8$$

where

K=0.5 when the steel contains boron,

K=0 when the steel does not contain boron and wherein, in the solid state, the number of titanium nitride precipitates of size greater than 0.1 μm, counted over an area of 1 $mm^2$ of a micrograph section, is less than 4 times the total content of titanium precipitated in the form of nitrides, this content being expressed in thousandths of a % by weight.

2. The steel as claimed in claim 1, wherein:

$$0.5\% \leqq Cr \leqq 3\%$$

$$0.1\% \leqq Mo+W/2 \leqq 2\%$$

$$Mn \leqq 2\%.$$

3. The steel as claimed in claim 1, wherein:

$$1.5\% \leqq Si+Al \leqq 2.5\%.$$

4. The steel as claimed in claim 1, wherein, $$0.2\% \leqq C \leqq 0.3\%.$$

5. The steel as claimed in any one of claim 1, claim 2, claim 3 or claim 4, wherein its chemical composition by weight comprises:

$$0.20\% \leqq C \leqq 0.24\%$$

$$0\% \leqq Si \leqq 2.5\%$$

$$1.2\% \leqq Mn \leqq 1.7\%$$

$$1.5\% \leqq Ni \leqq 2.5\%$$

$$0.5\% \leqq Cr \leqq 1.5\%$$

$$0.1\% \leqq Mo+W/2 \leqq 0.5\%$$

the chemical composition furthermore satisfying the relationships:

$$1.5\% \leqq Si+Al \leqq 2.5\%$$

and $$4.6\%\times(\%C)+1.05\times(\%Mn)+0.54\times(\%Ni)+0.66\times(\%Mo+\%W/2)+0.5\times(\%Cr)+K \geqq 3.8$$

where

K=0.5 when the steel contains boron,

K=0 when the steel does not contain boron.

6. A process for the manufacture of a component made of steel, comprising the steps of:

smelting a steel;

casting the steel and solidifying the steel in the form of a semi finished product;

forming the semi finished product by hot plastic deformation in order to obtain a steel component;

austenitizing the steel component by heating above $Ac_3$° C. and then cooling the steel component down to room temperature in such a way that the rate of cooling between the austenitizing temperature and $M_s$+150° C. is greater than 0.3° C./s, such that the holding time between $M_s$+150° C. and $M_s$−50° C. is between 5 minutes and 90 minutes and such that the cooling down to room temperature is faster than 0.02° C./s wherein the chemical composition of said steel comprises, by weight, $0.15\% \leqq C \leqq 0.35\%$ $0\% \leqq Si \leqq 3\%$ $0\% \leqq Al \leqq 3\%$ $0.1\% \leqq Mn \leqq 4.5\%$ $0\% \leqq Ni \leqq 9\%$ $0\% \leqq Cr \leqq 6\%$ $0\% \leqq Mo+W/2 \leqq 3\%$ $0\% \leqq V \leqq 0.5\%$ $0\% \leqq Nb \leqq 0.5\%$ $0\% \leqq Zr \leqq 0.5\%$ $N \leqq 0.3\%$ optionally from 0.0005% to 0.005% of boron, optionally from 0.005% to 0.1% of titanium, optionally at least one element taken from Ca, Se, Te, Bi and Pb in amounts less than 0.2%, the balance being iron and impurities resulting from smelting, the chemical composition furthermore satisfying the relationships:

$$1\% \leqq Si+Al \leqq 3\%$$

and, $$4.6\times(\%C)+1.05\times(\%Mn)+0.54\times(\%Ni)+0.66\times(\%Mo+\%W/2)+0.5\times(\%Cr)+K \geqq 3.8$$

where

K=0.5 when the steel contains boron,

K=0 when the steel does not contain boron.

7. A process for the manufacture of a component made of steel, comprising the steps of:

smelting a steel;

casting the steel and solidifying the steel in the form of a semi finished product;

heating the semi finished product to a temperature of less than 1300° C. and shaping the semi finished product by hot plastic deformation in order to obtain a steel component, in such a way that the temperature at the end of hot plastic deformation is greater than $Ac_3$;

cooling down the steel component to room temperature in such a way that the rate of cooling between the austenitization temperature and $M_s$+150° C. is greater than 0.3° C./s, such that the holding time between $M_s$+150° C. and $M_s$−50° C. is between 5 minutes and 90 minutes and such that the cooling down to room temperature is faster than 0.02° C./s wherein the chemical composition of said steel comprises, by weight, 0.15%≦C≦0.35%

0%≦Si≦3%

0%≦Al≦3%

0.1%≦Mn≦4.5%

0%≦Ni≦9%

0%≦Cr≦6%

0%≦Mo+W/2≦3%

0%≦V≦0.5%

0%≦Nb≦0.5%

0%≦Zr≦0.5%

N≦0.3% optionally from 0.0005% to 0.005% of boron, optionally from 0.005% to 0.1% of titanium, optionally at least one element taken from Ca, Se, Te, Bi and Pb in amounts less than 0.2%, the balance being iron and impurities resulting from smelting, the chemical composition furthermore satisfying the relationships:

$$1\% \leqq Si+Al \leqq 3\%$$

and, $$4.6\times(\%C)+1.05\times(\%Mn)+0.54\times(\%Ni)+0.66\times(\%Mo+\%W/2)+0.5\times(\%Cr)+K \geqq 3.8$$

where

K=0.5 when the steel contains boron,

K=0 when the steel does not contain boron.

8. The process as claimed in claim 6 or claim 7, wherein, in order to cool the component from the austenization temperature down to room temperature, the component is left to cool in air.

9. A steel component comprising the steel of claim 1, wherein its tensile strength is greater than 1200 MPa and its ductility measured by uniform elongation is greater than 5%.

10. The steel component as claimed in claim 9, wherein its structure contains at least 30% of bainite.

11. The component as claimed in claim 9 or claim 10, wherein it is a sheet having a thickness of greater than 8 mm.

12. The steel as claimed in claim 2, wherein:

$$1.5\% \leqq Si+Al \leqq 2.5\%.$$

13. The steel as claimed in claim 2, wherein:

$$0.2\% \leqq C \leqq 0.3\%.$$

14. The steel as claimed in claim 3, wherein:

$$0.2\% \leqq C \leqq 0.3\%.$$

15. The process as claimed in claim 6, wherein, in said steel:

0.005%≦Ti≦0.1%

0.01%≦Al≦0.5%

0.003%≦N≦0.02% and wherein, in the solid state, the number of titanium nitride precipitates of size greater than 0.1 μm, counted over an area of 1 $mm^2$ of a micrograph section, is less than 4 times the total content of titanium precipitated in the form of nitrides, this content being expressed in thousandths of a % by weight.

16. The process as claimed in claim 6, wherein, in said steel:

0.5%≦Cr≦3%

0.1%≦Mo+W/2≦2%

Mn≦2%.

17. The process as claimed in claim 6, wherein, in said steel, 1.5%≦Si+Al≦2.5%.

18. The process as claimed in claim 6, wherein, in said steel, 0.2%≦C≦0.3%.

19. The process as claimed in claim 6, wherein, in said steel, 0.20%≦C≦0.24%

0%≦Si≦2.5%

1.2%≦Mn≦1.7%

1.5%≦Ni≦2.5%

0.5%≦Cr≦1.5%

0.1%≦Mo+W/2≦0.5% the chemical composition furthermore satisfying the relationships:

$$1.5\% \leqq Si+Al \leqq 2.5\%$$

and $$4.6\%\times(\%C)+1.05\times(\%Mn)+0.54\times(\%Ni)+0.66\times(\%Mo+\%W/2)+0.5\times(\%Cr)+K \geqq 3.8$$

where

K=0.5 when the steel contains boron,

K=0 when the steel does not contain boron.

20. The process as claimed in claim 7, wherein, in said steel:

0.005%≦Ti≦0.1%

0.01%≦Al≦0.5%

0.003%≦N≦0.02% and wherein, in the solid state, the number of titanium nitride precipitates of size greater than 0.1 μm, counted over an area of 1 $mm^2$ of a micrograph section, is less than 4 times the total content of titanium precipitated in the form of nitrides, this content being expressed in thousandths of a % by weight.

21. The process as claimed in claim 7, wherein, in said steel:

0.5%≦Cr≦3%

0.1%≦Mo+W/2≦2%

Mn≦2%.

22. The process as claimed in claim 7, wherein, in said steel, 1.5%≦Si+Al≦2.5%.

23. The process as claimed in claim 7, wherein, in said steel, 0.2%≦C≦0.3%.

24. The process as claimed in claim 7, wherein, in said steel, 0.20%≦C≦0.24%

0%≦Si≦2.5%

1.2%≦Mn≦1.7%

1.5%≦Ni≦2.5%

$0.5\% < Cr \leqq 1.5\%$ $0.1\% \leqq Mo+W/2 \leqq 0.5\%$ the chemical composition furthermore satisfying the relationships:

$$1.5\% \leqq Si+Al \leqq 2.5\%$$

and $$4.6\% \times (\%C)+1.05 \times (\%Mn)+0.54 \times (\%Ni)+0.66 \times (\%Mo+\%W/2)+0.5 \times (\%Cr)+K \geqq 3.8$$

where

K=0.5 when the steel contains boron,

K=0 when the steel does not contain boron.

25. The steel component as claimed in claim 9, wherein the ductility measured by uniform elongation is from greater than 5% to 10.1%.

26. The steel component as claimed in claim 9, wherein said steel comprises from 5% to 30% austenite.

27. A steel component comprising steel whose composition comprises, by weight:

$0.15 \leqq C \leqq 0.35\%$ $0\% \leqq Si \leqq 3\%$ $0\% \leqq Al \leqq 3\%$ $0.1\% \leqq Mn \leqq 4.5\%$ $0\% \leqq Ni \leqq 9\%$ $0\% \leqq Cr \leqq 6\%$ $0\% \leqq Mo+W/2 \leqq 3\%$ $0\% \leqq V \leqq 0.5\%$ $0\% \leqq Nb \leqq 0.5\%$ $0\% \leqq Zr \leqq 0.5\%$ $N \leqq 0.03\%$ optionally from 0.0005% to 0.005% of boron, optionally from 0.005% to 0.1% titanium, optionally at least one element taken from Ca, Se, Te, Bi and Pb in amounts less than 0.2%, the balance being iron and impurities resulting from smelting, the chemical composition furthermore satisfying the relationships:

$$1\% \leqq Si+Al \leqq 3\%$$

and, $$4.6 \times (\%C)+1.05 \times (\%Mn)+0.54 \times (\%Ni)+0.66 \times (\%Mo+\%W/2)+0.5 \times (\%Cr)+K \geqq 3.8$$

where

K=0.5 when the steel contains boron,

K=0 when the steel does not contain boron, wherein said steel has a tensile strength greater than 1200 MPa and a ductility measured by uniform elongation of greater than 5%.

28. The steel component as claimed in claim 27, wherein the tensile strength of said steel is from greater than 1200 MPa to 1945 MPa and wherein the ductility measured by uniform elongation is from greater than 5% to 10.1%.

29. The steel component as claimed in claim 27 or claim 28, wherein said steel contains 5–30% austenite.

30. A process for manufacturing a component for a piece of equipment, comprising the step of shaping steel according to any one of claims 1, 2, 3 or 4 into said component.

* * * * *